US006699159B2

(12) United States Patent
Rouse

(10) Patent No.: US 6,699,159 B2
(45) Date of Patent: Mar. 2, 2004

(54) CAM ACTUATED FOLDING TREADMILL

(76) Inventor: J. Robert Rouse, 4501 Old Troup Hwy., Tyler, TX (US) 75707

( * ) Notice: Subject to any disclaimer, the term of this patent is extended or adjusted under 35 U.S.C. 154(b) by 47 days.

(21) Appl. No.: 10/160,850

(22) Filed: May 31, 2002

(65) Prior Publication Data

US 2003/0073544 A1 Apr. 17, 2003

Related U.S. Application Data

(60) Provisional application No. 60/329,008, filed on Oct. 11, 2001.

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,733,228 A * 3/1998 Stevens ..... 482/54
5,830,113 A * 11/1998 Coody et al. ..... 482/54
5,860,893 A * 1/1999 Waterson et al. ..... 482/54

* cited by examiner

*Primary Examiner*—Glenn E. Richman
(74) *Attorney, Agent, or Firm*—Ronald B. Sefrna

(57) ABSTRACT

A folding treadmill having a rotating bed assembly with a frame pivotally interconnected at one end to a stationary support structure, the weight of the bed assembly being balanced during rotation between a closed, generally vertical, position and an open, generally horizontal position by a counterbalancing cam assembly is provided by the present invention. In the preferred embodiment the cam assembly includes a pair of cams interconnected to the frame of the bed assembly, and a torque tube subassembly to impose lifting force against the rotating bed assembly through cam followers disposed between the cams and the torque tube so as to balance the bed assembly against the force of gravity through the range of rotational movement of the bed assembly.

18 Claims, 8 Drawing Sheets

CAM ACTUATED FOLDING TREADMILL

RELATED APPLICATION INFORMATION

This application claims the benefits of U.S. Provisional Patent Application Serial No. 60/329,008, filed Oct. 11, 2001, titled "Cam Actuated Self-Folding Treadmill".

FIELD OF THE INVENTION

The present invention generally relates to treadmill exercise apparatus, and in its preferred embodiments more specifically relates to a treadmill with pivoting bed assembly in which a cam actuated mechanism is provided to balance the weight of the bed assembly during lowering and raising operations.

BACKGROUND OF THE INVENTION

The use of treadmills is well known in the prior art, and they have been widely used exercise devices. The basic treadmill design incorporates a bed assembly with a continuous moving belt, driven by a motor, that runs in a shallow loop over rollers mounted at each end of a base frame of sufficient length to allow a user to walk or run freely in place as the belt moves. The basic treadmill also typically includes a generally upright assembly at the front of the bed assembly, usually incorporating handles that may be grasped by the user for stability, and may also include various controls and instruments. Typically, both the speed of the belt and the elevation of the front of the bed may be adjusted to allow the user to vary both rate of movement and the angle of the walking or running surface.

With the increased concern for fitness that has become prevalent in recent years, treadmills have become increasingly popular as home exercise devices. Although treadmills are very effective for that purpose, there is a disadvantage in a home setting arising from their size and the relatively large area of floor space they occupy. In an effort to overcome that disadvantage, treadmill designs with folding beds have been introduced. In typical folding bed designs the bed assembly is pivoted at the front end, that adjoins the upright support assembly, so that the entire bed assembly, including the motor, frame, belt, and bed support structure, can be folded to a vertical or near vertical position. The folding bed assembly approach addresses the space problem with reasonable effectiveness, but also introduces its own set of disadvantages. Especially in treadmills that provide effective support for walking or running, the weight of the bed assembly is substantial, and substantial force is required to lift the bed assembly to an upright position as well as to safely lower it to an unfolded position. The risk of injury from the strain of lifting and/or from the bed falling if dropped during the lifting or lowering process or if improperly secured in an upright position is significant.

Various approaches toward overcoming the problems with the folding treadmill concept have been tried, with some degree of success. In one approach, a motor is used to raise and lower the bed assembly, which is effective, but increases the cost of the treadmill significantly. In another approach, the bed assembly is spring biased toward the upright position. This approach is effective in reducing the lifting force required, but the bed assembly must be forced into an opened position to overcome the biasing force, and should be locked in the unfolded position for stability and safety, introducing another set of disadvantages for easy and safe operation.

There remains a need for a folding treadmill that addresses and overcomes the disadvantages of the prior art, that requires little force to open for use and to fold for storage, and that is safe during the folding procedure (both opening and closing), during use, and during storage.

SUMMARY OF THE INVENTION

The present invention provides a folding treadmill that includes a stationary frame assembly with a supporting base and an upright member or members connected to and extending upwardly from the supporting base, and that also includes a bed assembly pivotally connected at one end to the stationary frame so that the bed assembly can be rotated around that pivotal connection between a closed position, for storage, and an open position, for use of the treadmill, encompassing a rotational range of approximately ninety degrees. In the treadmill of the invention the bed assembly is manually raised and lowered, requires minimal force throughout both the raising and the lowering of the bed assembly, and is safely secured in an open, or lowered, position during use. The treadmill of the invention utilizes a unique cam assembly, including a torque rod and cam followers, to apply force acting against the weight of the bed assembly of the treadmill so as to not only reduce the force required to raise and lower the bed assembly, but also provides a significant safety feature by preventing the bed assembly from falling precipitously to the floor if released at any point in its travel between vertical and horizontal positions. The cam assembly also acts to secure the bed assembly in the fully open position, so as to provide a stable exercise platform during use of the treadmill, from which it can be easily released and returned to the closed position when use of the treadmill is completed.

The cam assembly includes a torque tube subassembly, with a pair of cam followers that act against a pair of uniquely designed cams. The torque tube subassembly includes a hollow tube, a pair of internal torque rods in the interior of the tube, each of which is connected to the tube and to a mounting arm which is firmly connected to the fixed frame of the treadmill. The tube is allowed to rotate around its longitudinal axis, and has a cam follower connected at each end. Each of the cam followers includes a roller at its outer end to contact and roll along the curved edge of one of the cams. The cams are mounted to the frame of the bed assembly, and move with that pivoting or folding bed assembly. Each cam has one flat edge that is received against the bed assembly frame, and one convexly curved edge along which the roller of the associated cam follower moves.

When the bed assembly of the treadmill is in the raised, or closed, position, the torque rods of the torque tube subassembly are generally relaxed, with minimal torsional load, and the cam followers are near the inner ends of the cams, where the distance between the flat and curved edges of the cams is least. As the bed assembly is rotated the cams move with the bed assembly and force the cam followers downward, increasing the torsional load on the torque rods. The rollers of the cam followers also move along the curved edge of the cam, which increases in distance from the flat edge of the cam toward the midpoint of the length of the cam. As the torsional load on the torque rods increases the force imposed by the cam followers against the cam increases, acting against the movement of the bed assembly with increasing force as the torsional load increases. The distance between the curved edge of each cam and the flat edge increases through, generally, the midpoint of the cam, and then begins to decrease toward the outer end of the cam. As a result, the rotational displacement of the cam followers attributable solely to the cams increases until the rollers of the cam followers pass, generally, the midpoint, and then decreases. However, the movement of the cams due to rotation of the bed assembly also causes a rotational displacement of the cam followers and an increase in torsional load of the cam followers. As the bed assembly is rotated around the hinge points from a closed, generally vertical, position toward an open, generally horizontal, position the center of mass is moved away from vertical alignment with the hinge and the force required to balance the bed assembly against the force of gravity increases. The components of the cam assembly are designed and adapted such that the vertical component of the force imposed by the cam followers closely balances the opposite vertical component of the gravitational force through the majority of the range of motion of the bed assembly. Accordingly, a user need apply minimal force to move the bed assembly through the majority of its range of motion during the opening and closing process.

For stability and safety, it is desirable for the bed assembly to be securely retained in both the closed position, for storage and in the open position, for use. Retention of the bed assembly in the closed position is preferably accomplished with a latch mechanism that must be released before the bed assembly can be pivoted open for use. Retention of the bed assembly in the open position is accomplished by providing a detent in the cams at their outer ends, which reduces the balancing force imposed by the cam assembly. When the bed assembly passes through a generally horizontal orientation as it is being opened and the outer end of the bed assembly continues downward into contact with the floor, the rollers of the cam followers move along the curved edge of the cam through a region of rapidly decreasing distance between the cam edges and into the detent, relieving a portion of the balancing force imposed by the cam assembly against the bed assembly so that the outer end of the bed assembly is held in firm contact with the floor by a portion of its own weight. When the bed assembly is to be closed, a sufficient lifting force must be imposed on the bed assembly to lift the outer end from the floor and move the cam follower rollers out of the detent and back into a position on the cam to more fully balance the weight of the bed assembly and allow the closing operation to be completed easily.

The structure and features of the preferred embodiment of the treadmill of the invention will be described in more detail with reference to the accompanying drawing figures.

BRIEF DESCRIPTION OF THE DRAWING FIGURES

DESCRIPTION OF THE PREFERRED EMBODIMENTS

Figure 1:
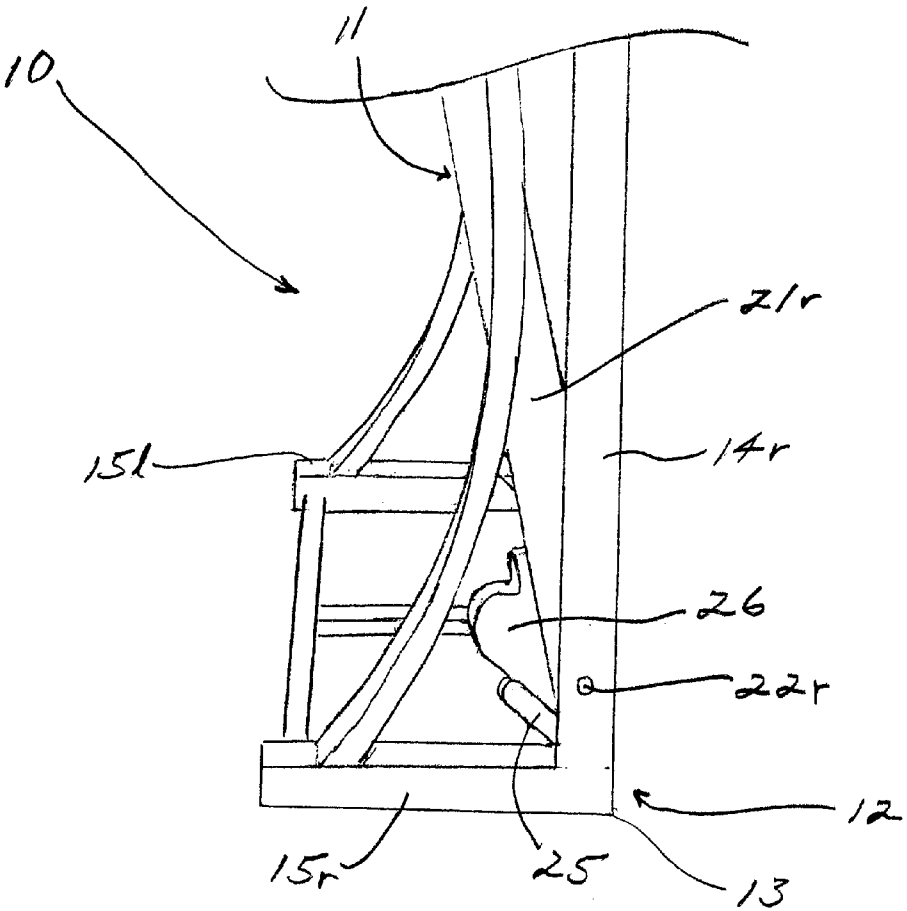
FIG. 1 is a side perspective view of a schematically illustrated treadmill assembly in accordance with the invention, showing the bed assembly in a raised position.
Figure 2:
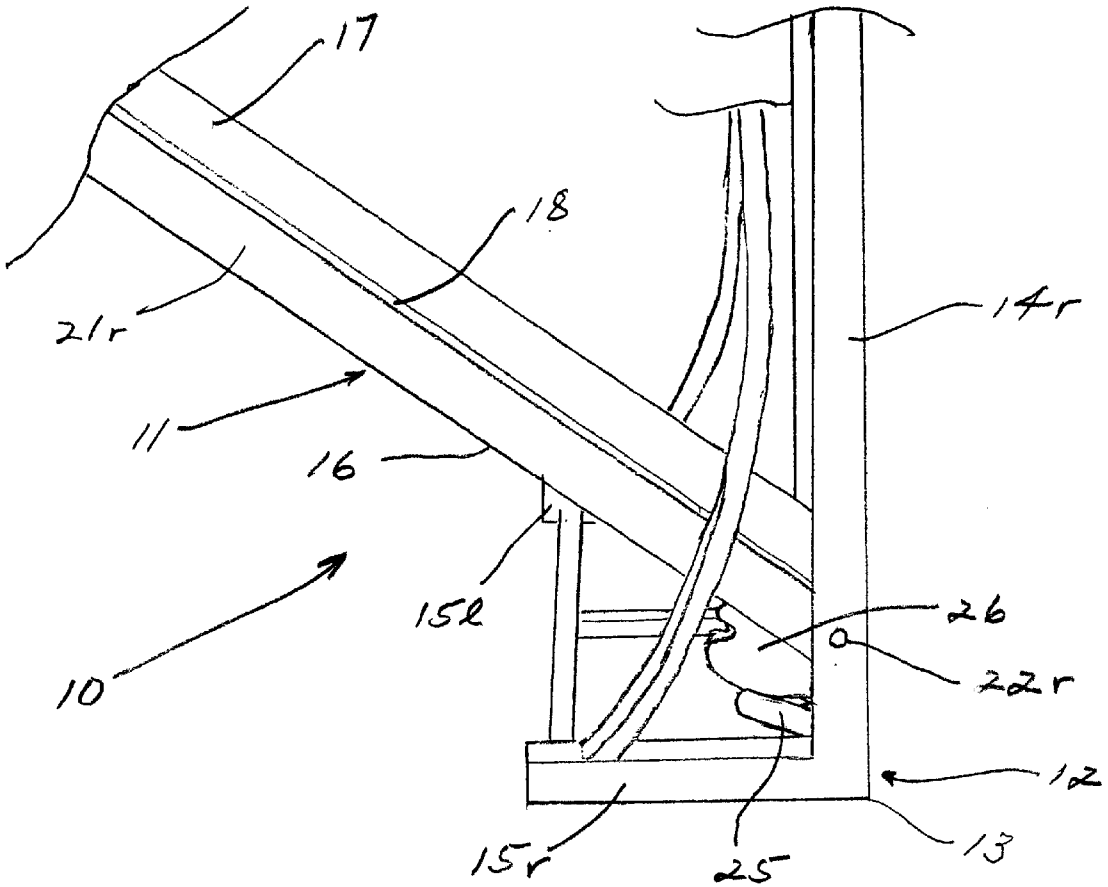
FIG. 2 is a side perspective view of a schematically illustrated treadmill assembly in accordance with the invention, showing the bed assembly in a partially lowered position.
Figure 3:
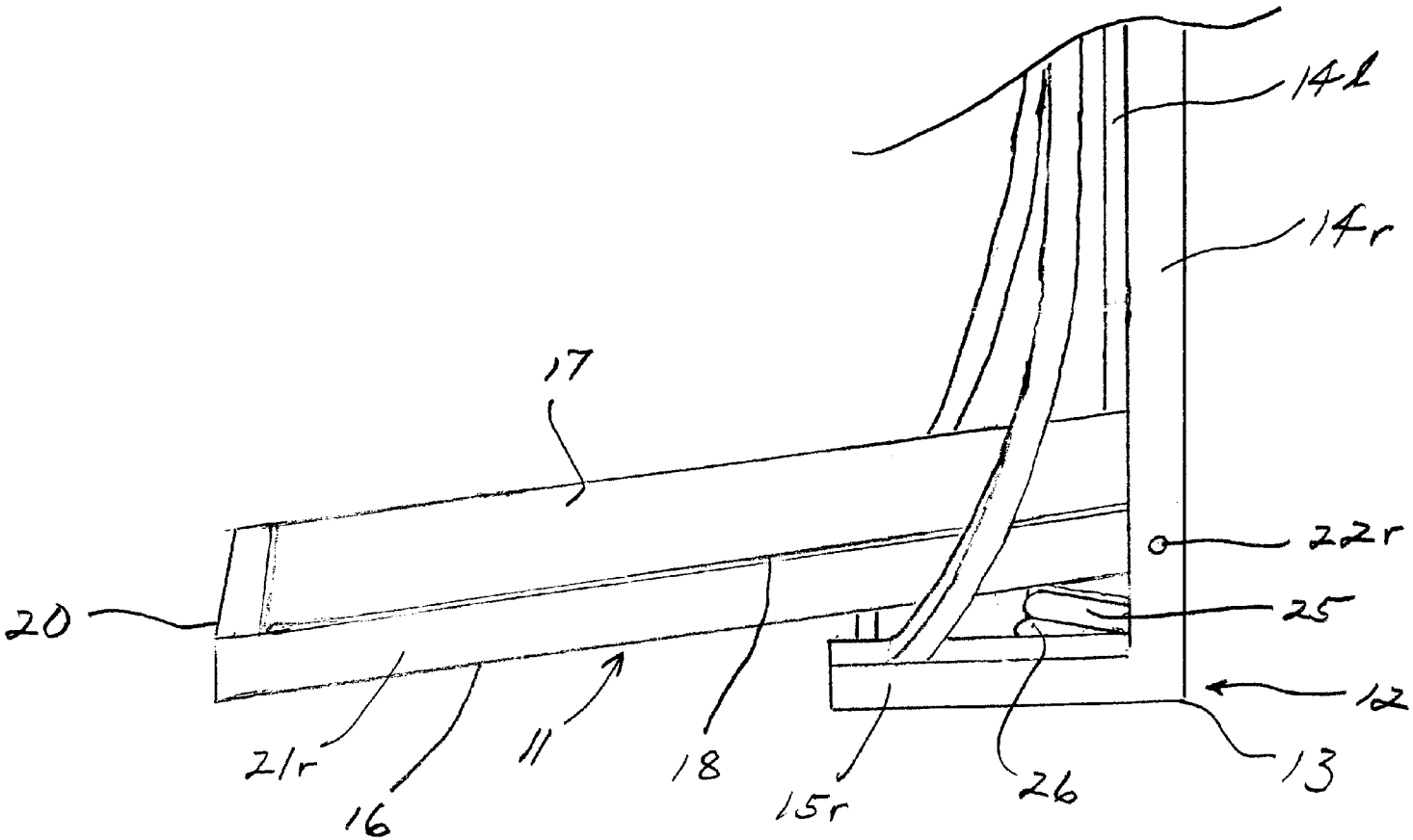
FIG. 3 is a side perspective view of a schematically illustrated treadmill assembly in accordance with the invention, showing the bed assembly in a fully lowered position.

Referring to the drawing figures, FIGS. 1, 2, and 3 schematically illustrate a treadmill structure in accordance with the invention, generally designated by reference numeral 10, which includes a pivoting bed assembly 11 and a stationary support assembly 12. Stationary assembly 12 includes a rigid frame 13, with vertical components 14*l* and 14*r* (left and right, respectively) and horizontal components 15*l* and 15*r*. The pivoting bed assembly includes a frame 16 and a continuous belt 17, driven by a motor (not shown) over a bed support 18. Bed assembly frame 16 has an inner end 19 and an outer end 20, and includes parallel elongate members 21*l* and 21*r* on the left and right sides of the bed assembly, respectively. The inner end 19 of the bed assembly frame 16 is pivotally connected to the stationary frame 13 by hinge pins 22*l* and 22*r*, preferably pivotally connecting components 21*l* and 21*r* to stationary components 14*l* and 14*r*, so as to allow the bed assembly to be rotated between a raised position for storage and a lowered position for use. In the raised position members 21 are disposed generally perpendicular to components 14, as in FIG. 1, and in the lowered position members 21 are disposed generally parallel to components 14, as in FIG. 3. FIG. 2 illustrates an intermediate position. In the drawing figures the upper portion of the support assembly and in FIGS. 1 and 2 the outer portion of the bed assembly are not shown, since the details of construction of those portions of the structure are conventional and not critical to the invention. It should also be understood that alternative embodiments with variations in the details of, e.g. the construction of the stationary frame, and the manner of pivotally connecting the bed assembly to the stationary frame, may be utilized, so long as the operational relationships among the components described herein are maintained.

Figure 4:
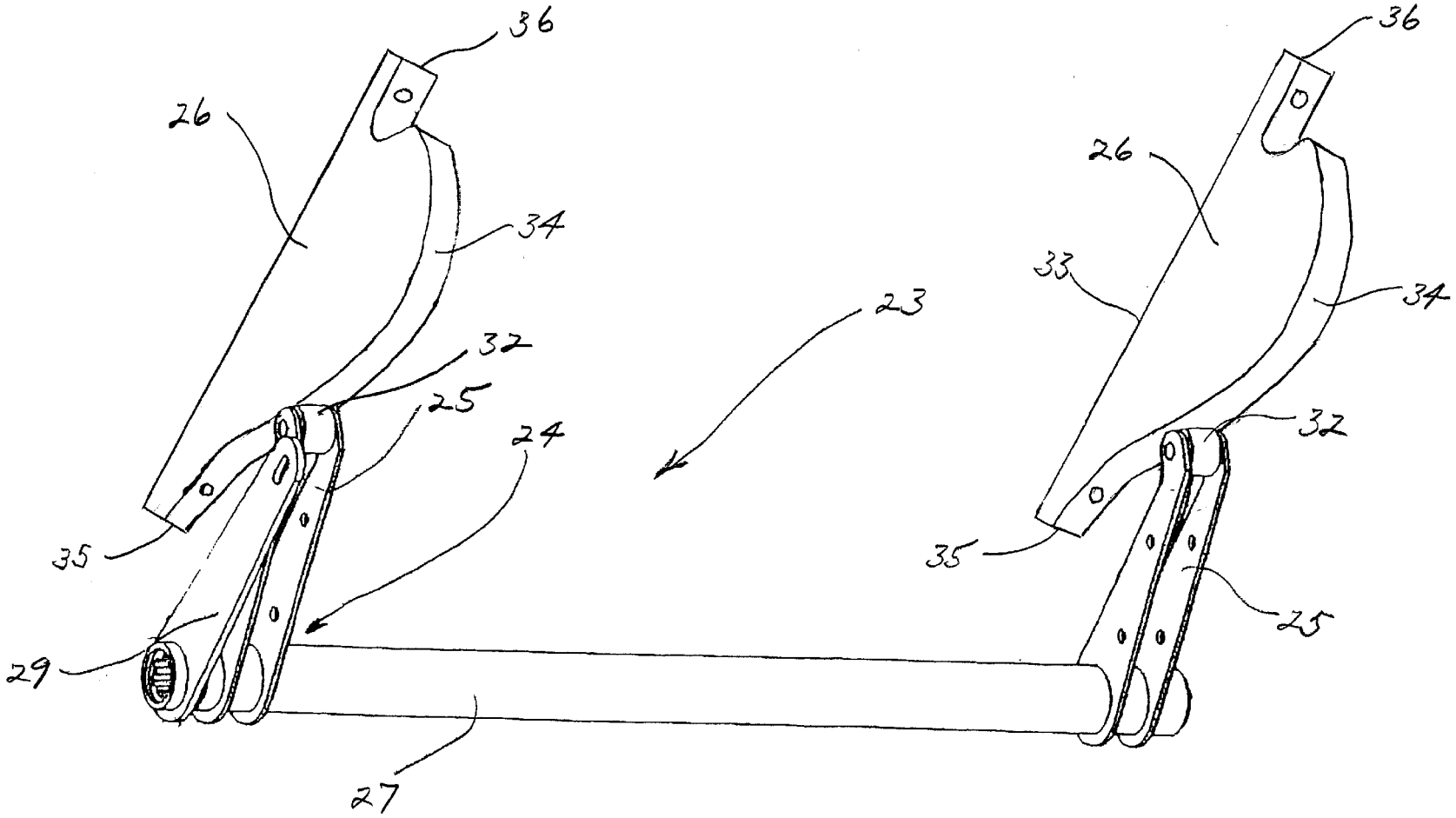
FIG. 4 is an isometric view of the cam assembly of the invention, in a configuration generally corresponding to the position of the bed assembly shown in FIG. 2.
Figure 5:
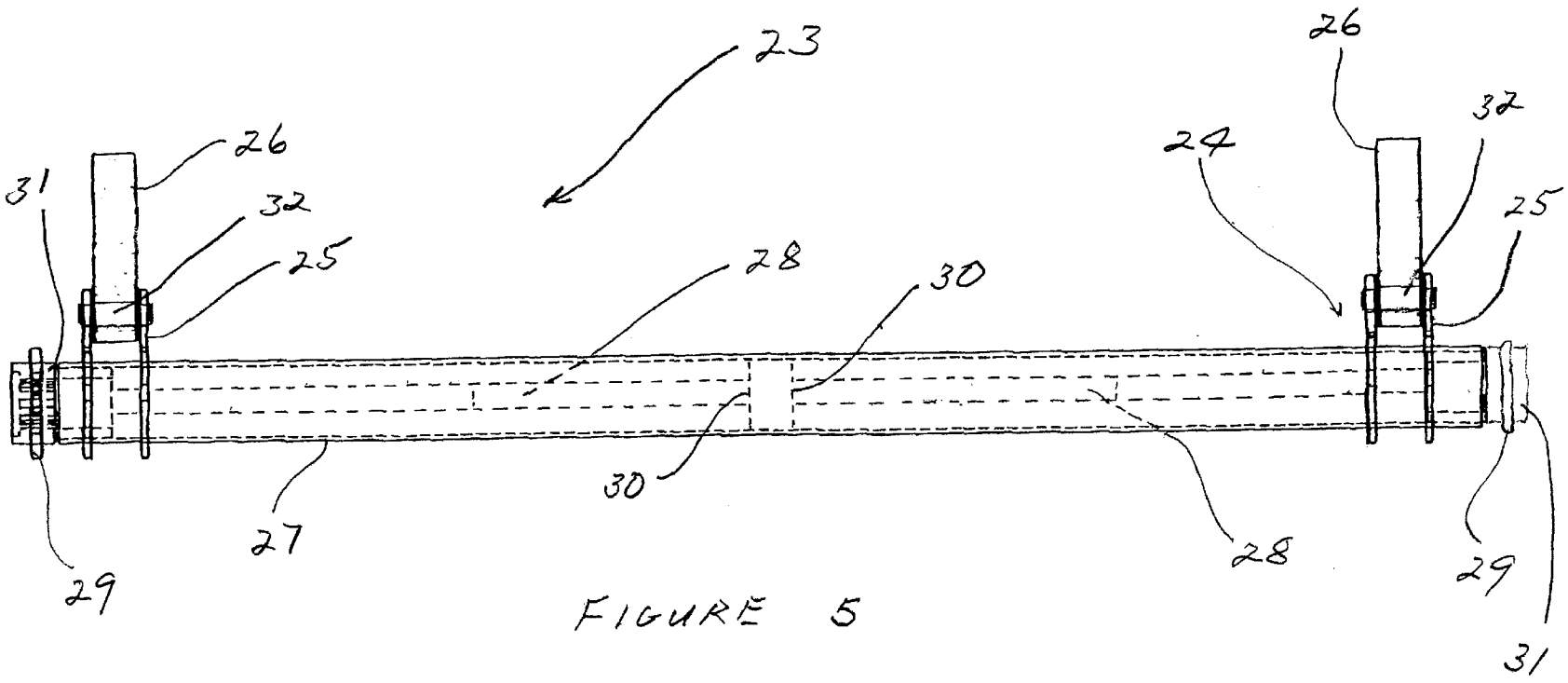
FIG. 5 is a front elevation view of the cam assembly of the invention.
Figure 6:
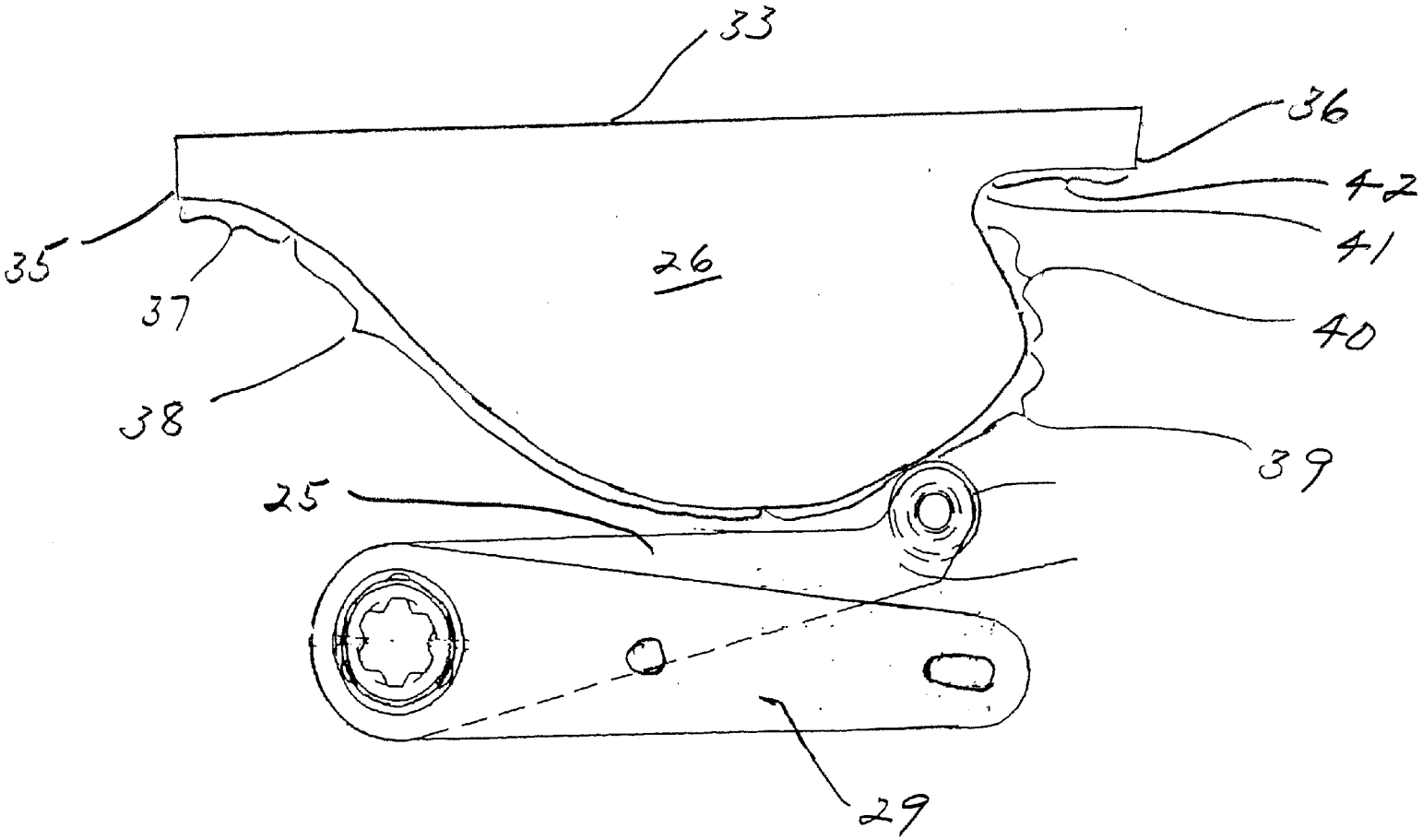
FIG. 6 is a left side elevation view of the cam assembly of the invention.

The cam assembly of the invention, generally designated by reference numeral 23, is shown in isolation in FIGS. 4, 5, and 6. The cam assembly includes a torque tube subassembly 24, which includes a pair of cam followers 25, and a pair of uniquely designed cams 26. The torque tube subassembly comprises a hollow tube 27, a pair of internal torque rods 28 disposed in the interior of tube 27, and a pair of mounting arms 29 disposed at the ends of tube 27. Each torque rod is fixedly connected at its inner end 30 to tube 27 and at its outer end 31 to a mounting arm 29, and tube 27 is allowed to rotate around its longitudinal axis relative to mounting arms 29, but is restrained against any lateral movement. Cam followers 25 are connected at one end to tube 27, and each includes a roller 32 at its opposite end to contact and roll along the curved edge of one of cams 26. Each of cams 26 is adapted to be rigidly mounted to an elongate member 21 of the bed assembly, and has one flat edge 33 to be received against the lower surface of the associated member 21, and one curved edge 34 to interact with a cam follower.

Figure 7:
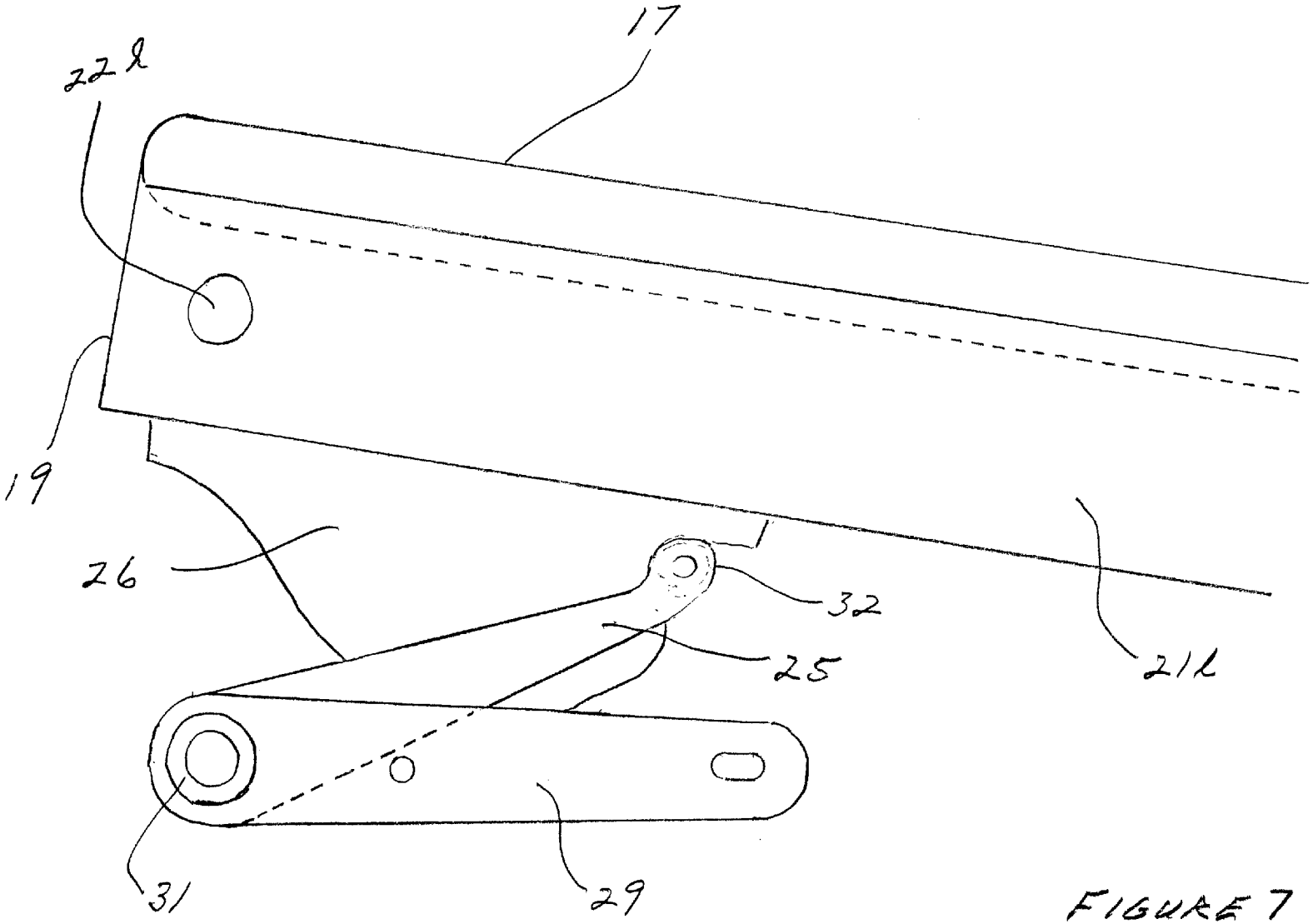
FIG. 7 is a left side elevation view of the bed assembly of the treadmill, with the cam assembly of the invention (omitting the upright assembly and upright assembly frame for clarity).

The cams are firmly connected to the lower surface of elongate members 21 of the bed assembly frame, and the torque tube subassembly 24 is mounted to stationary frame horizontal components 15 by firmly connecting mounting arms 29 to the frame. As shown most clearly in FIG. 7, the pivot point at which the bed assembly frame is hinged to frame components 14 is offset vertically from the axis of the torque tube assembly. With the components installed as shown in FIG. 7, rollers 27 of the cam followers are in contact with the curved edges 34 of the cams 26.

Each of cams 26 has an inner end 35, which is nearest to the inner end 19 of the bed assembly frame when the cams are connected to frame members 21, and an outer end 36. As shown in especially FIG. 6, in its preferred embodiment each cam follows a complex curvature from inner end 35 to outer end 36, with an initial generally flat segment 37 in which the distance between the edges of the cam is relatively constant, a smoothly curving segment 38 in which the distance between the edges of the cam increases to a maximum, a segment 39 in which the distance between the edges decreases smoothly, an escarpment 40 where the distance between the edges decreases rapidly, to a slightly undercut notch or detent 41, which continues into a final generally flat segment 42 in which the distance between the edges is approximately equal to that in the initial segment 37.

With the bed assembly 11 in a closed or raised position the rollers 32 of the cam followers are in the initial segment 37 or the beginning of segment 38, and the torque rods 28 are under minimum torsional load. As the bed assembly is rotated toward an open or lower position the movement of the cams causes the rollers to move along the curved edge of the cams and the cam followers 25 and tube 27 are caused to rotate around the axis of the tube, increasing the torsional load on the torque rods, and proportionally increasing the force imposed against the cams at the points of contact between the rollers 32 and the cam edge 34. As the bed assembly is further rotated the cam follower rollers move through segment 38 and into segment 39 of the cam edges, further increasing the torsional load on the torque rods and the force against the cams, until the bed assembly is generally horizontal, or level with the floor surface. Because the force imposed against the cams through the cam followers in reaction to the torsional load on the torque rods is sufficient to generally balance the bed assembly through its rotation to this point, very little additional force is required from the person lowering the bed assembly. As the bed assembly is lowered past horizontal to its tilted operating position, the cam followers reach the end of segment 39, where the torsional load on the torque rods reaches maximum, and move rapidly, under the force from and partially relieving the torsional load of the torque rods, along segment 40 and into detent 41 when the outer end of the bed assembly frame reaches the floor. In order to rotate the bed assembly in the opposite direction from this position, sufficient lifting force must be used to lift the outer end of the bed assembly frame and force the cam follower rollers along the escarpment segment 40 of the cam edges. Until such a lifting force is applied, the bed assembly is held in a fully open position and provides a stable platform for safe use of the treadmill.

When the user of the treadmill wishes to return the bed assembly to a closed, or raised position, the user lifts upward on the bed assembly to begin the closing process. A positive lifting force is requires to elevate the outer end of the bed assembly sufficiently for the cam follower rollers to move from the detent position in the cams along segments 40 of the cam edges and into segment 39, at which point the force imposed through the cam followers by the torque rods and the geometry of the cams is sufficient to generally balance the bed assembly. The remainder of the rotation of the bed assembly to a generally vertical position requires the person performing the operation to exert very little force. It is preferred that the bed assembly be latched in the closed, or raised position, for safety, and any convenient latching means may be used for that purpose.

As will be understood from the principles of mechanics, the lifting force required to balance the bed assembly against the force of gravity increases as the bed assembly is rotated from an essentially vertical closed position to a generally horizontal open position, because the bed assembly is pivotally connected at one end to the stationary frame of the treadmill. In the closed position the weight of the bed assembly is directly above and supported in the stationary frame by the hinge pins 22. As the bed assembly is rotated away from vertical, the horizontal distance of its mass from its pivot point is increased, increasing the length of the moment arm or lever represented by the bed assembly and correspondingly increasing the vertical lifting force required to be applied at the outer end of the bed assembly to balance it. As the bed assembly rotates the torsional load on the torque rods 28 increases as the rods twist, and the resistance to torsional displacement of the rods imposes a biasing force against rotation of the bed assembly. Unless the force imposed by the torque rods through the cam followers increases at the same rate as the effect of gravitational force during the rotation of the bed assembly, the desired balance between gravitational force and required lifting force cannot be maintained.

The placement of cams 26 between the cam followers and the frame of the bed assembly allows the angular displacement of the cam followers, and thus the twisting of the torque rods, to be controlled independently of the angular position of the bed assembly itself. Accordingly, the cams can be designed to provide any desired bed assembly balance characteristics through the full range of rotational movement between closed and open positions. As non-limiting examples, the bed assembly balance may be neutral through the rotational range; the balance may be biased toward a closed position, so that some degree of opening force is required to open the bed assembly for use; the balance may be biased toward an open position, so that some degree of closing force is required to close the bed assembly; or the balance may change during rotation, such as to require an opening force during the initial portion of the bed assembly rotation from closed to open and then to require a lifting force to maintain balance during the final portion of the bed assembly rotation to an open position. As described above, it is preferred that the cam design provide a transition in balancing force as the bed assembly nears the fully open position, so that the bed assembly is retained in an open position for safety and stability.

In the preferred embodiment torque rods are used to provide the balancing force, but it should be understood that other torsional biasing means could be used for alternative embodiments within the scope of the invention. A significant degree of variation in the force provided by the biasing means through the range of torsional displacement can be accommodated by appropriate design of the cam components of the treadmill of the invention to achieve the desired balance characteristics for the bed assembly through its rotation. Similarly, bed assemblies of differing size and weight may be readily accommodated. Further variations or alternative embodiments may be made within the scope of the invention. For example, though not preferred, the invention encompasses the use of a single cam and cam follower, or of multiple cams and cam followers, with a biasing means providing appropriate balancing force to balance the weight of the bed assembly.

Figure 8:
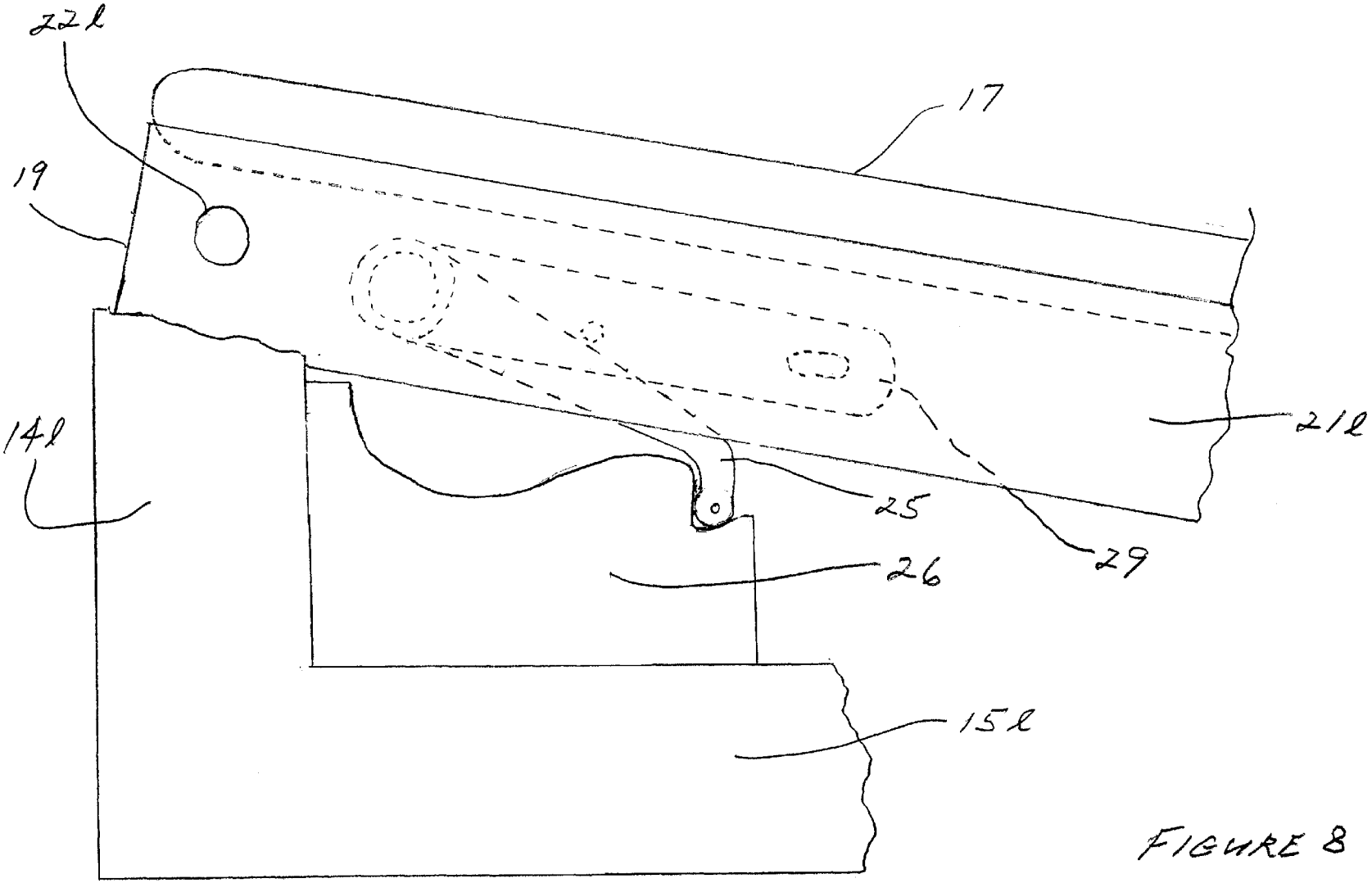
FIG. 8 is a left side elevation view of the bed assembly and a cutaway portion of the stationary frame of the, illustrating an alternative embodiment of the invention.

It is also preferred that the torque rod subassembly be connected to the stationary frame of the treadmill and the cams be connected to the bed assembly frame, as described above, but in an alternative embodiment the positions of those components may be reversed, as illustrated in FIG. 8. In the illustrated alternative, mounting arms 29 are connected to the bed assembly frame, so that the torque tube assembly is in fixed relation to, and moves with, the bed assembly. Cams 26 are connected to the stationary frame and remain stationary with that frame. In this alternative approach the configuration of the cams is different from the configuration of the cams of the preferred embodiment, in order to provide the required force profile against the bed assembly to balance the gravitational force acting against that assembly during its rotation.

The treadmill of the invention provides substantial and significant advantages and benefits over folding treadmill designs known and used in the prior art. Because of the dynamic balance of forces achieved by the present invention, movement of the bed assembly in both upward and downward rotation not only requires minimal effort, but is stable and controlled, eliminating any risk of the bed assembly crashing to the floor. The stable, controlled movement of the bed assembly assures the safety of the user and protects the treadmill mechanisms from damage. The torque tube subassembly and cams are relatively inexpensive and require essentially no maintenance to assure their continued effective operation. The design of the apparatus can be adapted to accommodate a wide range of bed assembly sizes and weights, and to provide a variety of balance characteristics for the bed assembly.

The foregoing description of the preferred embodiment and of alternative embodiments of the treadmill of the invention is intended to be illustrative rather than limiting. The invention is susceptible to additional alternative embodiments and variations, all of which are based upon the teaching provided herein and are encompassed within the scope of the claims.

What is claimed is:

1. A treadmill apparatus comprising a stationary frame having a supporting base and an upright member;

a bed assembly with a longitudinal axis and with first and second ends, having a moveable belt looped from said first end to said second end, said bed assembly being pivotally interconnected adjacent to said first end to said stationary frame such that said bed assembly is rotatable about said pivotal interconnection through a rotational range including a first position in which said longitudinal axis of said bed assembly is approximately parallel to said upright member of said stationary frame and a second position in which said longitudinal axis of said bed assembly is approximately parallel to said base of said stationary frame; and balancing means operatively connected between said stationary frame and said bed assembly for applying a force between said stationary frame and said bed assembly so as to approximately counteract the gravitational force acting on said bed assembly throughout said rotational range between said first position and said second position and between said second position and said first position, said balancing means including a biasing means for providing torsional force, said biasing means having a longitudinal axis, at least one cam follower with first and second ends, interconnected at said first end to said biasing means and extending generally perpendicular to said longitudinal axis of said biasing means and generally perpendicular to said longitudinal axis of said bed assembly, and at least one cam having a curved edge with a first end and a second end, said second end of said at least one cam follower received against said curved edge of said at least one cam so as to travel along said curved edge of said cam as said bed assembly is rotated, thereby transferring said torsional force provided by said biasing means through said at least one cam follower and said at least one cam between said stationary frame and said bed assembly.

2. The treadmill apparatus of claim 1, wherein said biasing means is interconnected to said stationary frame and said at least one cam is interconnected to said bed assembly.

3. The treadmill assembly of claim 1, wherein said biasing means is interconnected to said bed assembly and said at least one cam is interconnected to said stationary frame.

4. The treadmill apparatus of claim 1, wherein said biasing means comprises a torque tube assembly including an elongate hollow tube with at least one open end, at least one elongate torque rod with first and second ends, interconnected at said first end thereof to said tube in the interior of said tube, extending from said interior of said tube through said open end thereof, and interconnected at said second end to a mounting arm, with said at least one cam follower fixedly interconnected at said first end thereof to said tube.

5. The treadmill apparatus of claim 4, wherein said mounting arm is interconnected to said stationary frame and wherein said at least one cam is interconnected to said bed assembly.

6. The treadmill apparatus of claim 4, wherein said mounting arm is interconnected to said bed assembly and wherein said at least one cam is interconnected to said stationary frame.

7. The treadmill apparatus of claim 1, wherein the number of said cam followers is two and wherein the number of said cams is two.

8. The treadmill apparatus of claim 4, wherein said tube includes first and second open ends and has a longitudinal axis, wherein the number of said torque rods is two, each interconnected at said first end thereof to said tube in the interior thereof and extending in opposed relation from respective ones of said open ends of said tube and each interconnected at said second end to a said mounting arm, wherein the number of said cam followers is two and said cam followers are interconnected to said open ends of said tube in opposed parallel relation, wherein said mounting arms are connected to said stationary frame, such that said longitudinal axis of said tube is in fixed relation relative to said stationary frame and said tube and said cam followers are rotatable around said longitudinal axis of said tube, wherein the number of said cams is two, and wherein said cams are connected to said bed assembly such that said cams are in fixed relation relative to said bed assembly.

9. The treadmill apparatus of claim 8, wherein said bed assembly includes a pair of elongate bed assembly frame members disposed in opposed parallel relationship and extending between said first and second ends of said bed assembly, and wherein said each of said cams is connected to a respective one of said bed assembly frame members.

10. The treadmill apparatus of claim 2, wherein said at least one cam has a flat edge in opposed relation to said curved edge, wherein said at least one cam is interconnected to said bed assembly with said first end of said curved edge adjacent to said first end of said bed assembly, and wherein the distance between said edges of said at least one cam increases gradually from a point near said first end of said curved edge toward said second end of said curved edge to approximately the midpoint of said curved edge, decreases gradually from approximately said midpoint toward said second end of said curved edge, and then decreases rapidly to form a detent notch to receive said second end of said cam follower traveling along said curved edge of said cam when said bed assembly is rotated fully to said second position, so as to removably retain said second end of said cam follower in said detent notch and releasably secure said bed assembly in said second position.

11. The treadmill apparatus of claim 3, wherein said second end of said at least one cam follower is disposed near said first end of said curved edge of said at least one cam with said bed assembly in said first position and travels along said curved edge toward said second end thereof as said bed assembly is rotated from said first position toward said second position, and wherein said curved edge of said cam describes a detent notch adjacent to said second end of said curved edge to receive said second end of said cam follower when said bed assembly is rotated fully to said second position, so as to removably retain said second end of said cam follower in said detent notch and releasably secure said bed assembly in said second position.

12. A treadmill apparatus comprising a stationary frame having a supporting base with a pair of opposed parallel horizontal frame members, and an upright assembly with a pair of opposed parallel vertical frame members each interconnected to and extending generally perpendicular to a respective one of said horizontal frame members;

an elongate bed assembly with a longitudinal axis and with first and second ends, having a moveable belt looped from said first end to said second end, said bed assembly being pivotally interconnected adjacent to said first end to said upright assembly of said stationary frame such that said bed assembly is rotatable about said pivotal interconnection through a rotational range of approximately ninety degrees including a first position in which said longitudinal axis of said bed assembly is approximately parallel to said vertical frame members of said stationary frame and a second position in which said longitudinal axis of said bed assembly is angularly displaced from said vertical frame members slightly more than ninety degrees; and a cam assembly for applying force between said stationary frame and said bed assembly so as to approximately counteract the rotation inducing effect of gravitational force acting on said bed assembly throughout the majority of said rotational range between said first position and said second position and between said second position and said first position, said cam assembly including a torque tube subassembly having an elongate open ended hollow tube, a pair of cam followers each with first and second ends, each rigidly interconnected at said first end thereof to said tube adjacent to a respective open end thereof and extending perpendicular thereto, a pair of elongate torque rods each with first and second ends, each interconnected at said first end to said tube in the interior of said tube and extending from said interior of said tube through opposite of said open ends thereof, and a pair of mounting arms, each interconnected to said second end of a respective one of said torque rods, said mounting arms interconnected to said stationary frame, and said cam assembly further including a pair of cams interconnected to said bed assembly, each of said cams having a curved edge with a first end and a second end, with said second end of each of said cam followers received against said curved edge of a respective one of said cams so as to travel along said curved edge of said cam as said bed assembly is rotated, causing said tube to rotate and impose a torsional load on said torque rods.

13. The treadmill apparatus of claim 12, wherein said bed assembly includes a pair of elongate bed assembly frame members disposed in opposed parallel relationship and extending between said first and second ends of said bed assembly, and wherein each of said cams is connected to a respective one of said bed assembly frame members near said first end of said bed assembly.

14. The treadmill apparatus of claim 13, wherein said bed assembly frame members are pivotally interconnected to said vertical frame members of said vertical assembly of said stationary frame, and wherein said mounting arms are rigidly connected to said horizontal frame members of said base of said stationary frame.

15. The treadmill apparatus of claim 14, wherein said pivotal interconnection of said bed assembly frame members to said vertical frame members defines an axis of rotation of said bed assembly, wherein said tube of said cam assembly has a longitudinal axis, and wherein said longitudinal axis of said tube is parallel and vertically displaced below said axis of rotation.

16. The treadmill apparatus of claim 12, wherein said second end of each of said cam followers is disposed near said first end of said curved edge of the respective one of said cams with said bed assembly in said first position and travels along said curved edge toward said second end thereof as said bed assembly is rotated from said first position toward said second position, and wherein said curved edge of each of said cams describes a detent notch adjacent to said second end of said curved edge to receive said second end of the respective one of said cam followers when said bed assembly is rotated fully to said second position, so as to removably retain said second ends of said cam followers in said detent notches and releasably secure said bed assembly in said second position.

17. A treadmill apparatus comprising a stationary frame having a supporting base with a pair of opposed parallel horizontal frame members, and an upright assembly with a pair of opposed parallel vertical frame members each interconnected to and extending generally perpendicular to a respective one of said horizontal frame members;

an elongate bed assembly with a longitudinal axis and with first and second ends, having a moveable belt looped from said first end to said second end, said bed assembly being pivotally interconnected adjacent to said first end to said upright assembly of said stationary frame such that said bed assembly is rotatable about said pivotal interconnection through a rotational range of approximately ninety degrees including a first position in which said longitudinal axis of said bed assembly is approximately parallel to said vertical frame members of said stationary frame and a second position in which said longitudinal axis of said bed assembly is angularly displaced from said vertical frame members slightly more than ninety degrees; and a cam assembly for applying force between said stationary frame and said bed assembly so as to approximately counteract the rotation inducing effect of gravitational force acting on said bed assembly throughout the majority of said rotational range between said first position and said second position and between said second position and said first position, said cam assembly including a torque tube subassembly having an elongate open ended hollow tube, a pair of cam followers each with first and second ends, each rigidly interconnected at said first end thereof to said tube adjacent to a respective open end thereof and extending perpendicular thereto, a pair of elongate torque rods each with first and second ends, each interconnected at said first end to said tube in the interior of said tube and extending from said interior of said tube through opposite of said open ends thereof, and a pair of mounting arms, each interconnected to said second end of a respective one of said torque rods, said mounting arms interconnected to said bed assembly, and said cam assembly further including a pair of cams interconnected to said stationary frame, each of said cams having a curved edge with a first end and a second end, with said second end of each of said cam followers received against said curved edge of a respective one of said cams so as to travel along said curved edge of said cam as said bed assembly is rotated, causing said tube to rotate and impose a torsional load on said torque rods.

18. The treadmill apparatus of claim 17, wherein said bed assembly includes a pair of elongate bed assembly frame members disposed in opposed parallel relationship and extending between said first and second ends of said bed assembly, and wherein each of said mounting arms is connected to a respective one of said bed assembly frame members near said first end of said bed assembly.

* * * * *